United States Patent [19]

Russell

[11] 4,148,847

[45] Apr. 10, 1979

[54] CARBURETOR FLOAT BOWL WITH TEMPERATURE AND PRESSURE RESPONSIVE FUEL LEVEL CONTROL MEANS

[76] Inventor: Albert C. Russell, One Eastwood La., Belleair, Fla. 33516

[21] Appl. No.: 808,130

[22] Filed: Jun. 20, 1977

[51] Int. Cl.[2] ..... F02M 5/00

[52] U.S. Cl. ..... 261/39 A; 261/70

[58] Field of Search ..... 261/39 A, 70, DIG. 67

[56] References Cited

U.S. PATENT DOCUMENTS

| | | | |
|---|---|---|---|
| 1,532,291 | 4/1925 | Woolson | 261/39 A X |
| 1,712,460 | 5/1929 | Purdy et al. | 261/39 A X |
| 1,817,069 | 8/1931 | Dickey | 261/70 X |
| 2,111,855 | 3/1938 | Groh | 261/39 A X |
| 2,633,342 | 3/1953 | Baker | 261/70 X |
| 2,662,757 | 12/1953 | Mock | 261/39 A |

*Primary Examiner*—Carlton R. Croyle

*Assistant Examiner*—Michael Koczo, Jr.

*Attorney, Agent, or Firm*—Gifford, Chandler, VanOphem, Sheridan & Sprinkle

[57] ABSTRACT

A novel carburetor is provided which maintains a substantially constant fuel/air ratio in accordance with the density of the incoming air by variably controlling the fuel level in the carburetor fuel bowl. To accomplish this, a first and second lever are positioned between the fuel inlet valve to the carburetor fuel bowl and the float in the fuel bowl so that the position of each lever variably and independently variably controls the vertical position of the float at the point of closure of the fuel inlet valve, and hence the fuel level in the fuel bowl. An aneroid bellows controls the position of one lever while a temperature element controls the position of the other whereby the fuel level in the fuel bowl is proportionate to both air pressure and temperature, and hence the air density.

5 Claims, 5 Drawing Figures

Fig-1
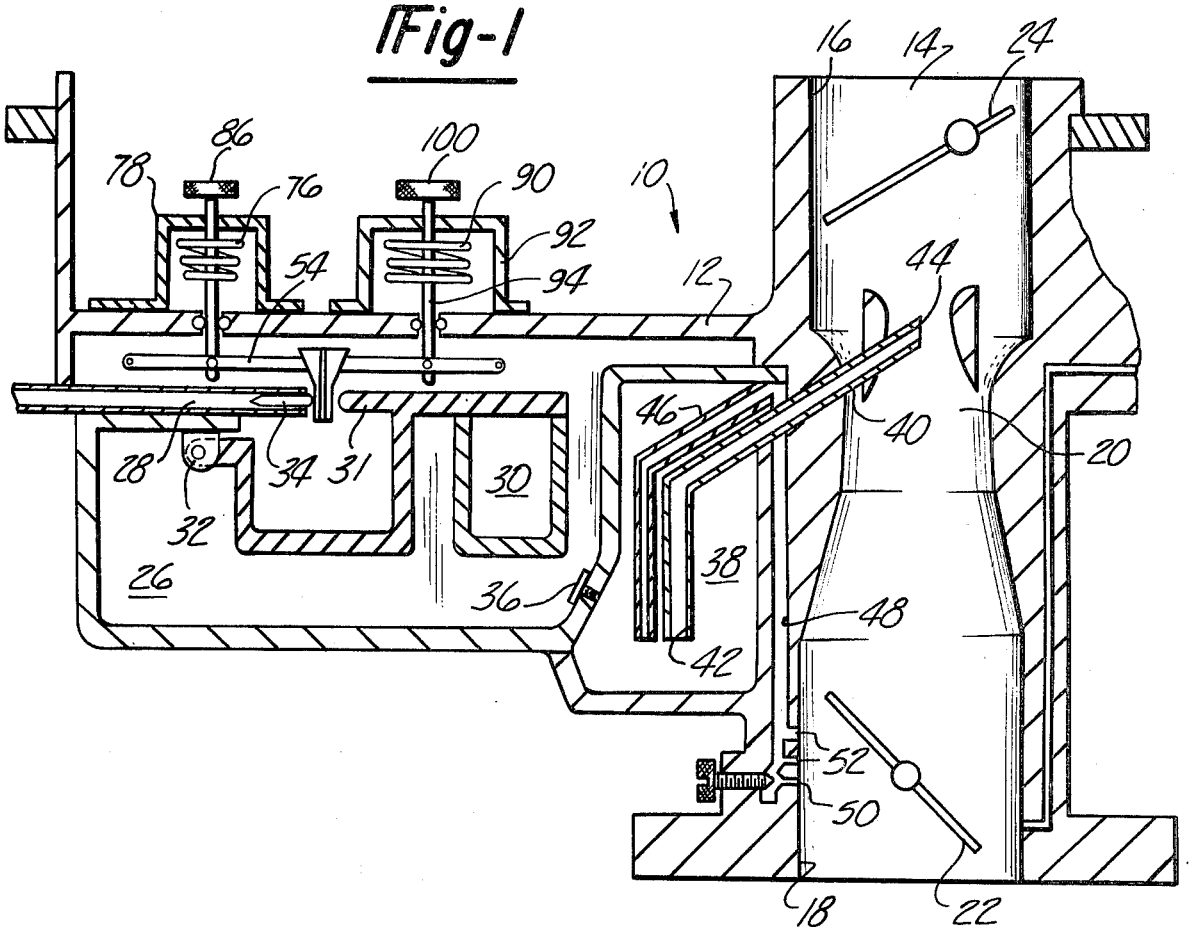
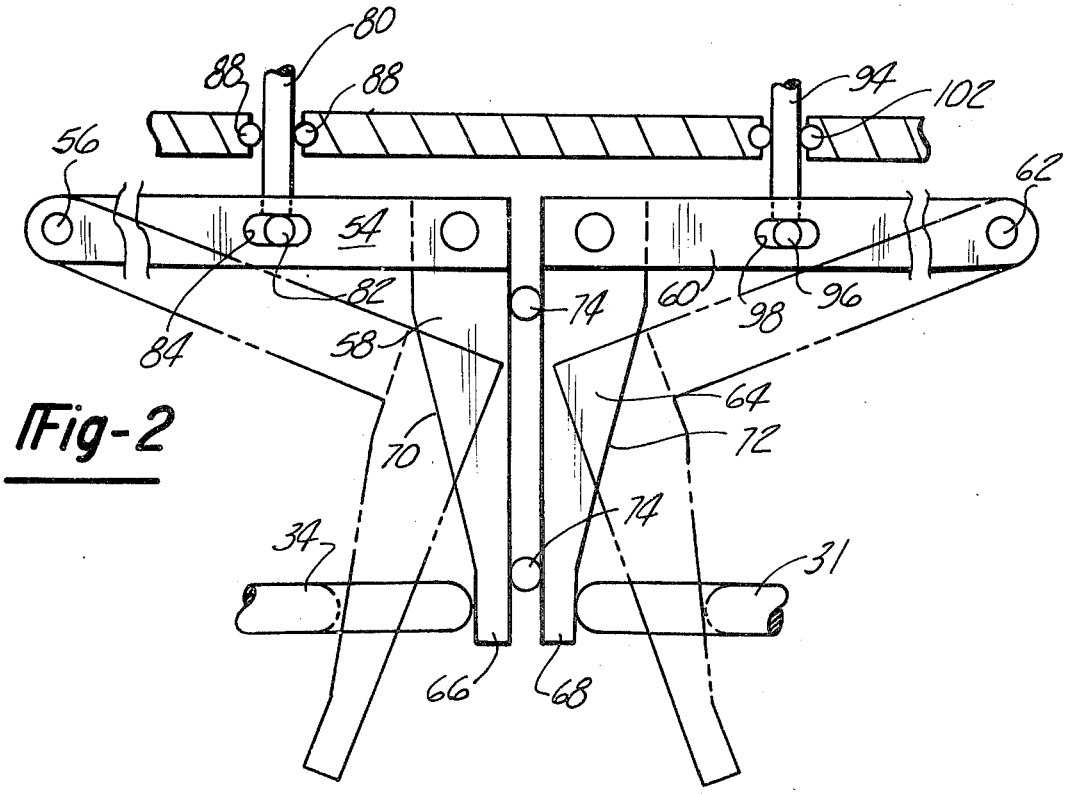
Fig-2

FROM THIS POINT ON CARBURETOR IS THE SAME AS FIG-1

CARBURETOR FLOAT BOWL WITH TEMPERATURE AND PRESSURE RESPONSIVE FUEL LEVEL CONTROL MEANS

BACKGROUND OF THE INVENTION

I. Field of the Invention

The present invention relates generally to carburetors and, more particularly, to a carburetor with pressure and temperature compensating means.

II. Description of the Prior Art

There are a plurality of previously known carburetors and many of these carburetors employ a housing with a fuel or float bowl into which fuel is supplied by a fuel pump. A float is mounted within the float bowl and is operatively connected with a fuel shut-off valve so that the float permits the fuel valve to open only when the fuel in the float bowl falls below a predetermined level. In this fashion, the float maintains the fuel at a predetermined and constant level within the float bowl. Moreover, the fuel level in the float bowl determines the amount of fuel supplied to the engine via the carburetor venturi, idle and transfer ports.

It has been the conventional practice with these previously known carburetors to preset the float to maintain a fuel level designed to supply the desired amount of fuel to the venturi at a barometric pressure of 29.92 inches of mercury and a temperature of 60° F. Consequently, at this air pressure and temperature, the previously known carburetors generate or create the proper fuel/air ratio for the most efficient operation of the engine. Conversely, when the pressure and temperature vary from these standards, the fuel/air ratio of the combustible mixture produced by the carburetor also varies and produces either overly rich or overly lean fuel/air mixtures. These deviations from the ideal operating conditions in turn result in increased exhaust pollutants and reduced gas mileage for the engine utilizing the carburetor.

There have been several previously known carburetors which employ altitude compensation means for regulating the fuel/air mixture with the barometric pressure changes. However, no previously known carburetor has been heretofore known for controlling the fuel/air ratio proportionately with both the barometric pressure and temperature, and hence density, of the incoming air to the carburetor.

SUMMARY OF THE PRESENT INVENTION

The carburetor according to the present invention overcomes these above-mentioned disadvantages of the previously known carburetors by providing a carburetor which varies the fuel delivery to the carburetor proportionately with both the pressure and temperature, and hence density, of the incoming air thereby maintaining a substantially constant fuel/air ratio.

In brief, the carburetor of the present invention achieves this by varying the fuel level in the carburetor float blowl proportionately with both the pressure and temperature of the incoming air to the carburetor. An aneroid bellows varies the position of a pressure control lever disposed between the carburetor float in the float bowl and the fuel inlet valve to the float bowl. Likewise, a temperature responsive element controls the position of a temperature control lever also positioned between the carburetor float and the fuel shut-off valve to the float bowl.

The position of both of the control levers together determines the vertical position of the curburetor float at the point of closure of the fuel valve to the float bowl and thus controls the fuel level in the float bowl. The fuel level in the float bowl in turn controls the fuel/air ratio generated by the carburetor and maintains the fuel/air ratio at a constant value regardless of the density of the incoming air to the carburetor.

As a still further improvement upon the previously known carburetors, a mechanical plunger is situated on the carburetor which, upon activation, extends and opens the throttle via the throttle linkage to the carburetor. The activation of the plunger is controlled by means of a speed sensor coupled to the engine so that when the engine speed falls below a predetermined value, the plunger is activated thus opening the throttle and preventing the stalling of the engine at low engine speeds.

As will become more readily apparent as the description proceeds, the carburetor according to the present invention is of simple, rugged, and yet relatively inexpensive construction capable of long and maintenance-free operation.

BRIEF DESCRIPTION OF THE DRAWING

The carburetor according to the present invention will be more fully understood upon reference to the following detailed description when read in conjunction with the accompanying drawing wherein like reference characters refer to like parts throughout the several views, and in which:

FIG. 1 is a side cross-sectional view illustrating the carburetor according to the present invention;

FIG. 2 is a fragmentary partial sectional view illustrating one component of the carburetor of the present invention and enlarged for clarity;

DETAILED DESCRIPTION OF THE PRESENT INVENTION

Figure 3:
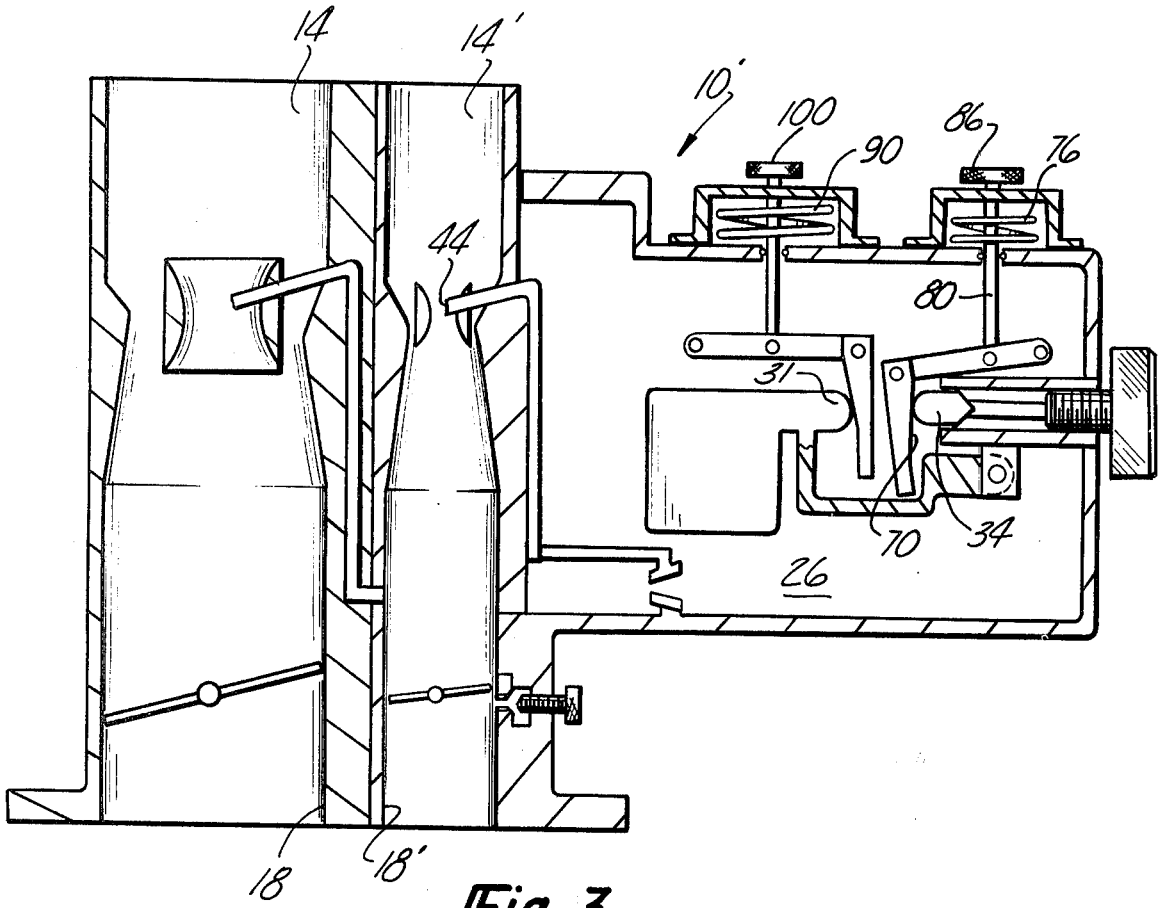
FIG. 3 is a cross-sectional view of a carburetor of the present invention similar to FIG. 1, but showing a modification thereof.

With reference first to FIG. 1, a carburetor 10 according to the present invention is thereshown and comprises a carburetor housing 12 defining an air horn 14 having an air intake 16 and an outlet 18 which is coupled to an intake manifold (not shown) of an internal combustion engine. In addition, a venturi 20 is provided within the air horn 14 for increasing the air flow speed therethrough in the normal fashion. A conventional throttle plate 22 and choke plate 24 selectively open and block the air flow through the air horn 18.

A float chamber or fuel bowl 26 is also formed within the carburetor housing 12 and is supplied with fuel from a fuel supply line 28 connected to the output from a fuel pump (not shown). A float 30 having a contact arm 31 is disposed within the chamber 26 and pivotally connected at one end 32 to the housing 12. The float contact arm 31 is mechanically coupled in a manner which will be shortly described to a fuel cut-off valve 34 so that fuel flow from the fuel supply line 28 and into the float chamber 26 is terminated when the float reaches a predetermined level in the float chamber 26. Conversely, as fuel is used from the chamber 26, the float 30 drops slightly and the valve 34 opens and permits fuel flow into the chamber 26 until the float 30 again achieves its valve shut-off level.

The float chamber 26 is fluidly coupled through a main metering jet 36 to an inner fuel chamber 38 also formed within the carburetor housing 12. A fluid conduit 40 is open at its lower end 42 to the inner fuel chamber 38 and forms a main fuel discharge 44 at its upper end which is open in the venturi 20. The main fuel discharge 44 typically is positioned above the fuel level in the inner chamber 38 but, due to the air flow through the venturi, fuel is drawn up through the conduit 40 due to the venturi effect and discharged at the main discharge 44. In addition, fuel is also supplied from the inner chamber 38 through a second conduit 46, a passageway 48, and to an idle fuel port 50 and transfer ports 52 formed in the carburetor housing 12. The carburetor thus far described is conventional in construction.

With reference now to both FIGS. 1 and 2, a first lever 54 is pivotally conected at one end 56 to the carburetor housing 12 above the float bowl 26. A downwardly extending fuel level positioner 58 is connected to the other end of the first lever 54 and is disposed between the fuel cut-off valve 34 and the float contact arm 31. Similarly, a second lever 60 is pivotally connected at one end 62 to the carburetor housing 12 above the float bowl 26. A downwardly extending second fuel level positioner 64 is secured to its other end and adjacent the first fuel level positioner 58 and between the fuel shut-off valve 34 and the float contact arm 31.

The first fuel level positioner 58 includes a ramp portion 70 facing the fuel cut-off valve 34 while, similarly, the second fuel level positioner 64 includes a ramp portion 72 facing the float contact arm 31. Suitable stop members 74 are positioned between the fuel level positioners 58 and 64 so that the lever arms 60 and 54 can pivot on their respective pivot points 62 and 56 to the position shown in phantom line in FIG. 2. In doing so, due to the ramp portions 70 and 72 on the fuel level positioners 58 and 64, the overall width of the fuel level positioners 58 and 64 between the fuel cut-off valve 34 and float contact arm 31 can be varied. This in turn varies the vertical position of the float 30, and hence the fuel level in the fuel bowl 26, at the point of shut-off of the fuel valve 34. Moreover, each of the level pivot points 56 and 62 is provided with lateral play so that levers 54 and 60 can shift slightly laterally in order to permit both the opening and closure of the fuel shut-off valve 34 despite the pivotal position of the levers 54 and 60.

The pivotal position of the lever 54 is controlled by means of an aneroid bellows 76 mounted in a bracket 78 on the carburetor housing 12. The aneroid bellows 76 is coupled to the lever 54 by means of a control rod 80 having a pin 82 at its lowermost end which is received in a slot 84 formed in the lever 54. The aneroid bellows 76 is sealed and operatively axially extends or retracts the rod 80 proportionately with the air pressure surrounding the bellows 76. The bellows 76 is open to atmospheric air so that the air pressure surrounding the bellows 76 is substantially identical to the air pressure of the air entering the air horn 14. In addition, an adjusting nut 86 on the bellows 76 is provided to preset the initial vertical position of the rod 80 while a suitable seal 88 is positioned around the rod 80 and against the housing 12 to prevent fuel leakage from the float bowl 26.

Similarly, the pivotal position of the lever 60 is controlled by means of a temperature responsive element 90 secured to the carburetor housing by a bracket 92. A control rod 94 is connected to the temperature element 90 at its upper end while a pin 96 at its lower end is received within a lateral slot 98 in the lever 60. Like the aneroid bellows 76, the temperature sensitive element 90 can also be initially preset by means of an adjusting screw 100 while an O-ring seal 102 prevents fuel leakage from the float bowl 26.

In the operation of the carburetor 10 of the present invention as thus far described, the vertical position of the individual control rods 80 and 94, and hence the pivotal position of the levers 54 and 60, respectively, varies proportionately with both the pressure and temperature of the incoming air and hence proportionately with the density of the air. The axial position of the control rods 80 and 94 control the position of the level positioners 58 and 64 and thus determine the vertical position of the float 30 in the float chamber 26 at the point of closure of the fuel valve 34. The fuel level, of course, varies with the bearing width of the ramp portions 70 and 72 positioned between the float contact arm 31 and the fuel shut-off valve 34. Moreover, the fuel level within the float chamber 26 determines the amount of fuel provided at the fuel discharge 44 and the idle and transfer ports 50 and 52. The ramp portions 70 and 72 of the level positioners 58 and 64 can be contoured whereby the fuel/air ratio emitting from the outlet 18 of the air horn 14 remains constant despite the temperature and pressure, and hence density, of the incoming air to the carburetor 10. By providing the optimum and substantially constant fuel/air ratio to the engine, fuel economy is maximized while a simultaneous reduction in pollution emissions is obtained.

With reference now to FIG. 3, a carburetor 10' according to the present invention is thereshown and corresponds substantially to the carburetor 10 illustrated in FIG. 1 with the exception of a pair of air horns 14 and 14', rather than the single air horn 14 shown in FIG. 1. In all other respects, the carburetor 10' is substantially the same as the carburetor 10. However, as shown in FIG. 3, the pressure control rod 80 is more downwardly extended than shown in FIG. 1 so that the upper portion of the ramp 70 is positioned between the valve 34 and the float contact arm 31. Such a condition would occur underneath low pressure or high altitude engine operation and would result in a lowering of the fuel level within the float chamber 26 thereby reducing the fuel supply to the main fuel discharge 44. However, due to the lower density of air entering the horn 14 or 14', the fuel/air ratio emitting from the outlet 18 of the air horn 14 remains substantially constant over a wide range of operating conditions.

Figure 5:
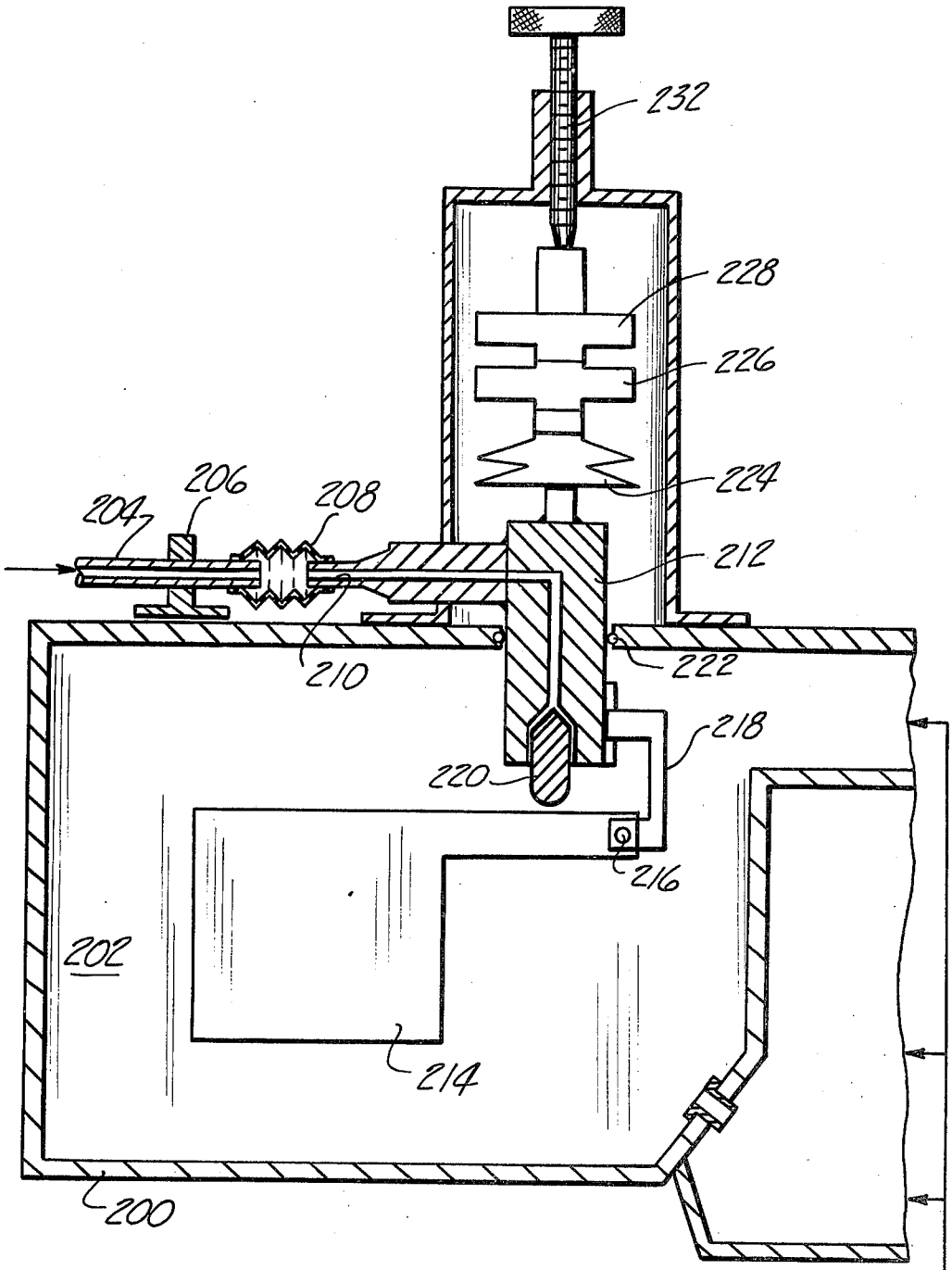
FIG. 5 is a fragmentary partial sectional view illustrating a modification of the carburetor according to the present invention.

A still further embodiment of the present invention is illustrated in FIG. 5 and comprises a carburetor housing 200 defining an interior float chamber 202. A fuel inlet line 204 is attached to the carburetor housing 200 by a bracket 206 and is fluidly connected through a flexible coupling 208 to the inlet 210 of a fuel lever controller 212. A float 214 is pivotally coupled at 216 to a support 218 secured to the controller 212. The float 214 is in turn operatively coupled with a fuel inlet valve 220 carried at the lower end of the controller 212 for selectively permitting fuel flow into the float chamber 202.

The controller 212 is vertically slidably mounted relative to the housing 200 through annular seal 222 whereby the vertical position of the controller 212 determines the fuel level in the float chamber 202. A series combination of an aneroid bellows 224, a temperature compensation element 226 and a moisture control element 228 is contained within a bracket assembly 230 secured to the housing 200 above the controller 212. The lower end of the aneroid bellows 224 is coupled to the upper end of the controller 212 while the upper end of the moisture control element 228 is vertically adjustably secured to the bracket 230 via an adjusting screw 232. The moisture control element 228, temperature control element 226 and the aneroid bellows 224 axially expand and contract in dependence upon the relative humidity, temperature and pressure of the air surrounding these elements 224–228, and hence in dependence upon the density of the incoming air to the carburetor 10. The expansion or compression of the elements 224–228 determines the vertical position of the controller 212 relative to the housing 200 and hence the fuel level in the fuel bowl 202. The fuel level in the fuel bowl 202 in turn controls the fuel mixture to the engine in the previously described manner which, for brevity, will not be here repeated.

Figure 4:
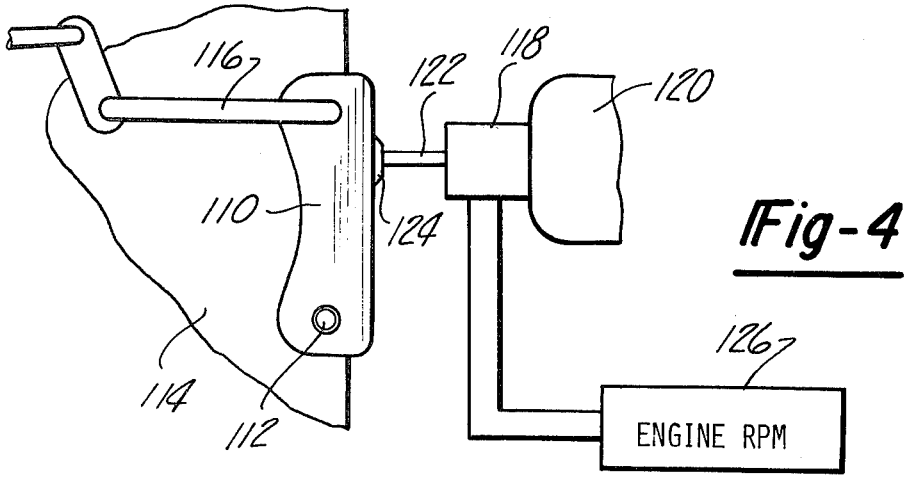
FIG. 4 is a fragmentary partial diagrammatic view illustrating the vehicle anti-stall mechanism of the carburetor according to the present invention.

With reference now to FIG. 4, further improvement to the carburetor 10 is thereshown and comprises a control arm 110 which is pivotally mounted at 112 to a stationary support 114. A mechanical linkage 116 is secured to the upper end of the control arm 110 and the link 116 is mechanically coupled to the throttle plate 22 (FIG. 1). A solenoid means 118 is secured to a stationary mount 120 and includes a plunger 122 which, upon extension, contacts an abutment plate 124 on the control arm 110 to move the control arm 110 in a counterclockwise direction. The solenoid means 118 is selectively actuated by sensor means 126 which is responsive to the engine RPM. Thus, when the engine RPM falls below a predetermined value, the means 126 activates the solenoid means 118 to extend the plunger 122 and move the control arm 110 in a counterclockwise direction. This action in turn slightly opens the throttle plate 22 and prevents stalling of the vehicle engine. This simple means shown in FIG. 4 thus effectively prevents stalling of the vehicle and is advantageously utilized in conjunction with the carburetor 10 shown in FIG. 1.

From the foregoing, it can be seen that unlike the previously known carburetors, the carburetor 10 according to the present invention effectively maintains a substantially constant fuel/air ratio regardless of the density of the incoming air. This is achieved by controlling the fuel level in the float bowl 26 by means independently responsive to both the air pressure and air temperature. No other previously known carburetor has heretofore provided means for controlling the fuel level in the float bowl proportionately with the air density.

Having thus described my invention, many modifications thereto will become apparent to those skilled in the art to which it pertains without deviation from the spirit of the invention as defined by the scope of the appended claims.

I claim:

1. In a carburetor of the type having a housing, air flow passage means formed through said housing, a fuel bowl formed in the housing and fluid passage means in said housing for fluidly connecting said fuel bowl to said air flow passage means, a source of fuel fluidly connected to the float bowl, float means contained within the interior of the float bowl for maintaining the fuel level in the float bowl at a determinable level, said float means being pivotally coupled to said housing and including a contact arm mechanically coupled to a fuel valve, the improvement which comprises, temperature means operatively connected with said float means for varying said determinable fuel level proportionately with the temperature of the air flow through said air flow means, pressure means operatively connected with said float means for varying said determinable fuel level proportionately with the air pressure of the air surrounding said carburetor, said pressure means further comprising a first level positioner axially disposed between said contact arm and said fuel valve, said first level positioner having a contoured edge which varies the width between said contact arm and said fuel valve in accordance with the axial position of said first level positioner, and means responsive to air pressure for varying the axial position of said level positioner, said temperature means further comprising a second level positioner axially disposed between said contact arm and said fuel valve, said second level positioner having a contoured edge which varies the width between said contact arm and said fuel valve in accordance with the axial position of said second level positioner, and means responsive to air temperature for varying the axial position of said second level positioner, wherein said level positioners are positioned in a side-by-side relationship with respect to each other and so that said contoured edges of said level positioners face away from each other, one contoured edge abutting against said contact arm and the other edge abutting against said fuel valve, said level positioners being movable independently of each other.

2. The invention as defined in claim 1 wherein said pressure means further comprises an aneroid bellows and means for operatively connecting said bellows with said first level positioner.

3. The invention as defined in claim 2 wherein said connecting means further comprises a lever pivotally coupled to said housing at one end and attached to said first lever positioner at its other end and a control rod attached to bellows at one end and connected to a midpoint on said lever at its other end.

4. The invention as defined in claim 1 wherein said temperature means further comprises a temperature responsive element and means for operatively connecting said element with said second level positioner.

5. The invention as defined in claim 4 wherein said last mentioned means comprises a lever pivotally coupled to said housing at one end and attached to said second level positioner at its other end and a control rod attached to said element at one end and connected to a midpoint on said lever at its other end.

* * * * *

UNITED STATES PATENT AND TRADEMARK OFFICE

CERTIFICATE OF CORRECTION

PATENT NO. : 4,148,847

DATED : April 10, 1979

INVENTOR(S) : Albert C. Russell

It is certified that error appears in the above-identified patent and that said Letters Patent are hereby corrected as shown below:

Column 3, line 49, delete "level" and insert --lever-- therefor.

Signed and Sealed this

*Tenth* Day of *July 1979*

[SEAL]

*Attest:*

*Attesting Officer*

LUTRELLE F. PARKER

*Acting Commissioner of Patents and Trademarks*